US006997576B1

(12) United States Patent
Lodhie et al.

(10) Patent No.: US 6,997,576 B1
(45) Date of Patent: Feb. 14, 2006

(54) LIGHT-EMITTING DIODE LAMP AND LIGHT FIXTURE INCLUDING SAME

(75) Inventors: Pervaiz Lodhie, Rolling Hills, CA (US); Lei U. Vinoya, Long Beach, CA (US)

(73) Assignee: Ledtronics, Inc., Torrance, CA (US)

( * ) Notice: Subject to any disclaimer, the term of this patent is extended or adjusted under 35 U.S.C. 154(b) by 145 days.

(21) Appl. No.: 10/680,917

(22) Filed: Oct. 8, 2003

(51) Int. Cl.
*F21V 1/00* (2006.01)

(52) U.S. Cl. ..... 362/240; 362/223; 362/800; 362/812

(58) Field of Classification Search ..... 362/240, 362/244, 249, 217, 223, 800, 812
See application file for complete search history.

(56) References Cited

U.S. PATENT DOCUMENTS

| | | | | |
|---|---|---|---|---|
| 5,283,612 | A * | 2/1994 | Lodermann et al. | 399/107 |
| 5,661,374 | A * | 8/1997 | Cassidy et al. | 315/307 |
| 6,457,270 | B1 * | 10/2002 | Stark et al. | 40/570 |
| 6,659,622 | B1 * | 12/2003 | Katogi et al. | 362/219 |
| 2003/0102810 | A1 | 6/2003 | Cross et al. | |
| 2004/0062041 | A1 | 4/2004 | Cross et al. | |

* cited by examiner

*Primary Examiner*—John Anthony Ward
(74) *Attorney, Agent, or Firm*—Irving Keschner

(57) ABSTRACT

An LED lamp has a substantially planar circuit board having two opposed sides, and a plurality of light-emitting diodes (LEDs) grouped to form two LED arrays. The LEDs of one of the two LED arrays are mounted along opposite edges of one of the sides of the circuit board. The LEDs of the other LED array are mounted along opposite edges of the other side of the circuit board.

3 Claims, 6 Drawing Sheets

LIGHT-EMITTING DIODE LAMP AND LIGHT FIXTURE INCLUDING SAME

BACKGROUND OF THE INVENTION

1. Field of the Invention

This invention relates generally to electric lamps and light fixtures including electric lamps, and more particularly to tubular electric lamps such as fluorescent lamps and light fixtures including such tubular lamps.

2. Description of Related Art

A typical electric light fixture includes an electric lamp. Common types of electric lamps include fluorescent lamps and incandescent lamps.

A light-emitting diode (LED) is a diode that emits light when a current passes through it. A diode is a semiconductor device through which current can pass in only one direction. LEDs are often used as indicator lights, and are also commonly used in computer system "laser" printers and compact disk read only memory (CD-ROM) drives.

LEDs are in general more efficient, last longer, and are more durable than fluorescent and incandescent lamps. In general, LEDs are about 4 times more efficient at producing light than fluorescent lamps, and approximately 16 times more efficient at producing light than incandescent lamps. Unlike fluorescent and incandescent lamps, LEDs are extremely shock resistant. While an incandescent lamp may produce light for 750 to 2,000 operating hours, and a fluorescent lamp may produce light for 12,000 to 24,000 hours of continuous use, many LEDs can produce light for 100,000 hours of continuous use. For the above reasons, LEDs are generally preferred over fluorescent and incandescent lamps in critical applications.

SUMMARY OF THE INVENTION

The present invention teaches certain benefits in construction and use which give rise to the objectives described below.

The present invention provides a lamp having a circuit board having two opposed ends. A plurality of light-emitting diodes (LEDs) are disposed upon the circuit board. A pair of projections extending outwardly from each of the two opposed ends. The pair of projections are electronically connected to the LEDs.

A primary objective of the present invention is to provide an LED lamp having advantages not taught by the prior art.

Another objective is to provide an LED lamp that may be used to replace an existing fluorescent lamp.

Another objective is to provide an LED lamp that is inexpensive to operate.

A further objective is to provide an LED lamp that is durable and long lasting.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
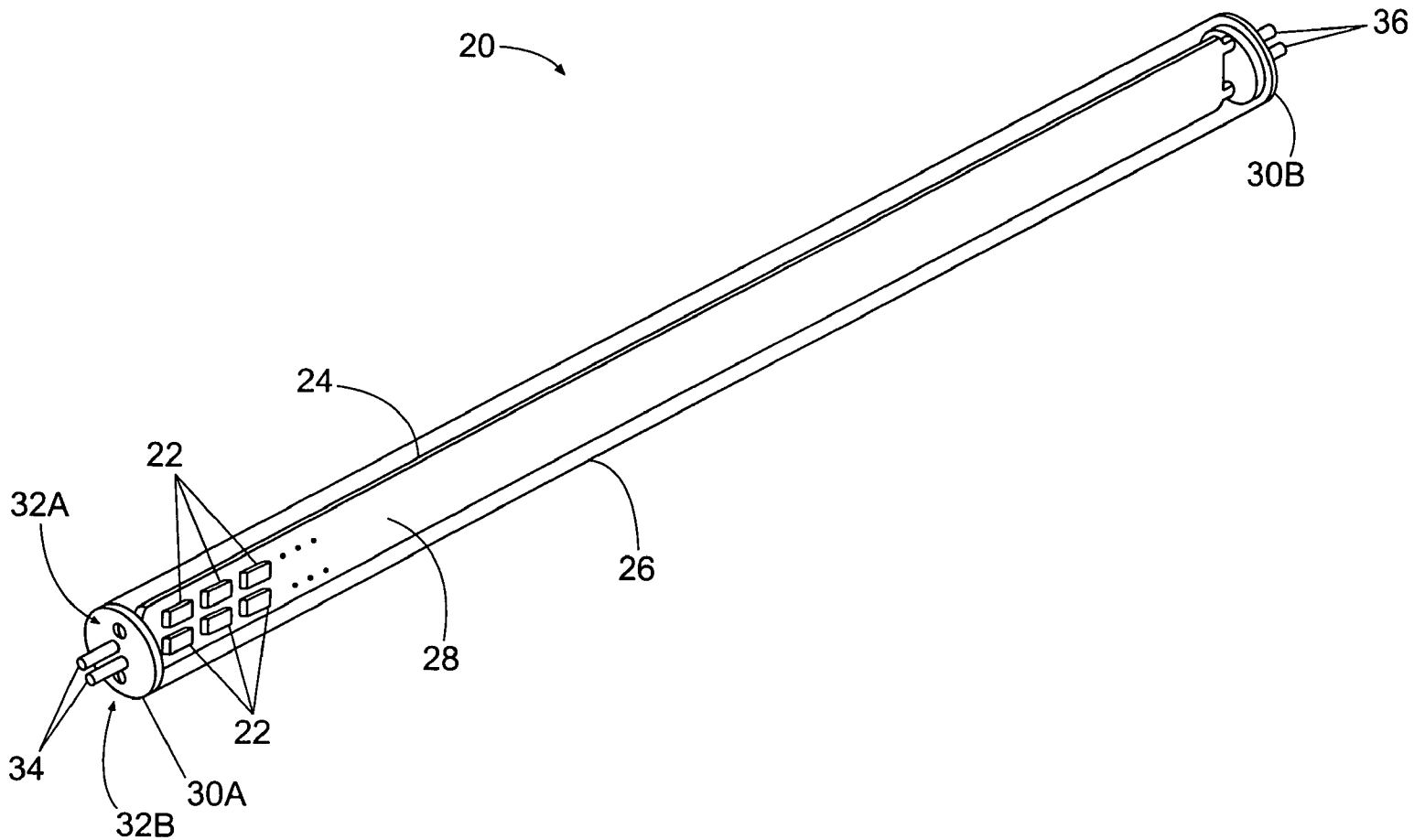
FIG. 1 is a perspective view of one embodiment of an electric lamp including multiple light-emitting diodes (LEDs) mounted along opposite edges of opposite sides of a substantially planar printed circuit board (PCB), wherein the PCB is positioned within a tubular sheath.

FIG. 1 is a perspective view of one embodiment of an electric lamp 20 including multiple light-emitting diodes (LEDs) mounted along opposite edges of opposite sides of a substantially planar printed circuit board (PCB) 24. As described in more detail below, the multiple LEDS are arranged to form two LED arrays. The LEDs of one of the LED arrays are mounted along opposite edges of one side of the PCB 24, and the LEDs of the other LED array are mounted along opposite edges of the other side of the PCB 24. As shown in FIG. 1, the PCB 24 is positioned within a tubular sheath 26, and light emitted by the multiple LEDs passes through the tubular sheath 26.

In the embodiment of FIG. 1, the sheath 26 is a hollow cylinder made of a material substantially transparent to visible light (i.e., is substantially "clear"). In FIG. 1, LEDs 22 of one of the LED arrays mounted to a side 28 of the PCB 24 are visible through the sheath 26. In the embodiment of FIG. 1, the LEDs 22 are mounted along opposite edges of the side 28 of the PCB 24.

Two ends caps 30A and 30B installed at opposite ends of the tubular sheath 26 are adapted to properly position and hold the PCB 24 in the sheath 26. More specifically, the PCB 24 has two opposed ends, and each end has two projections extending outwardly therefrom. One of the ends corresponds to the end cap 30A, and the other end corresponds to the end cap 30B. As shown in FIG. 1, the end cap 30A has two holes 32A and 32B adapted to receive the corresponding projections of the PCB 24. The end cap 30B also has two holes for receiving the corresponding projections of the PCB 24. When the end caps 30A and 30B are inserted into the opposite ends of the sheath 26 such that the projections of the PCB 24 reside in the corresponding holes in the end caps 30A and 30B, the PCB 24 is properly positioned and held in the sheath 26.

In the embodiment of FIG. 1, the lamp 20 is intended to advantageously replace a preheat-type fluorescent lamp, having a bi-pin base on each end, in a light fixture adapted to receive preheat-type fluorescent lamps. Accordingly, the end cap 30A has two pins 34 extending outward therefrom in parallel for connecting to an electrical power source, and the end cap 30B has two similar pins 36. The pins 34 and 36 are adapted for insertion into bi-pin lamp holders of the light fixture.

In the embodiment of FIG. 1, and as described in more detail below, the pins 34 at one end of the lamp 20 are connected together, the pins 36 at the other end of the lamp 20 are connected together, and two wires having an alternating current voltage between them are connected to the pins 34 and 36 to provide electrical power to the lamp 20; however, it should be understood that the lamp 20 could also be adapted for use with DC voltage as well.

In general, the multiple LEDs of the lamp 20 (including the LEDs 22) emit visible light. In one embodiment, the LEDs of the lamp 20 are surface mount LEDs that emit red light having wavelengths between about 620 nanometers and approximately 680 nanometers. In one particular embodiment, the red LEDs of the lamp 20 emit light having wavelengths of about 660 nanometers. In other embodiments, the LEDs of the lamp 20 may emit, for example, other colors of visible light, such as orange, yellow, and/or green, or white light having a broad range of wavelengths.

In general, the sheath 26 is substantially transparent to the wavelengths of visible light emitted by the LEDs of the lamp 20, and prevents objects and liquids from coming into contact with the LEDs and the PCB 24. The sheath 26 may be, for example, formed from a plastic material or a rugged type of glass. Suitable plastic materials include acrylic plastic resins such as Plexiglas® (Atofina Chemicals, Inc., Philadelphia, Pa.) and polycarbonate resins such as Lexan® (General Electric Company, Schenectady, N.Y.). Suitable rugged types of glass includes borosilicate glass such as Pyrex® (Corning Inc., Corning, N.Y.).

Figure 2:
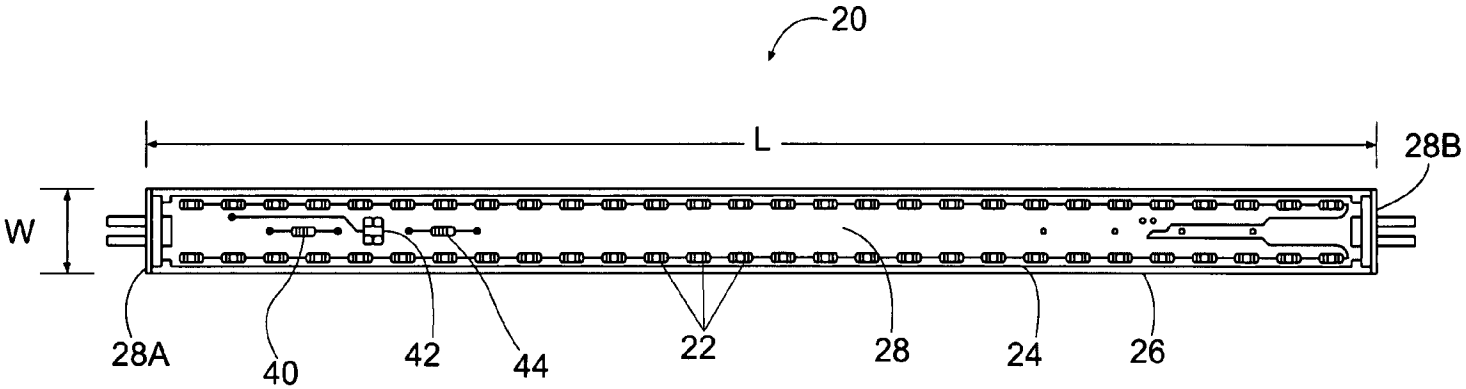
FIG. 2 is a side elevation view of the lamp of FIG. 1 wherein one side of the PCB is visible through the sheath.

FIG. 2 is a side elevation view of the lamp 20 of FIG. 1 wherein the side 28 of the PCB 24 is visible through the sheath 26. As described above, the LEDs 22 are mounted along opposite edges of the side 28 of the PCB 24. In the embodiment of FIG. 2, the LEDs 22 number 56; 28 of the LEDs 22 are mounted along one edge of the side 28, and the remaining 28 LEDs 22 are mounted along the opposite edge of the side 28. Conductive traces of the PCB 24 connect all 56 of the LEDs 22 in series. It should be understood that while the present embodiment includes two groups of 28 LEDs, the lamp 20 could include alternative numbers of LEDs, and groups of LEDs, and these alternative embodiments should be considered within the scope of the present invention.

In the embodiment of FIGS. 1 and 2, the lamp 20 has a length dimension "L" of about 11.42 inches, and a width dimension "W" of approximately 0.75 inch. The sheath 26 has an outer diameter of about 0.75 inches and an inner diameter of approximately 0.63 inches. It is noted that the above dimensions L and W of the lamp 20 are substantially similar to corresponding dimensions of industry standard T5 fluorescent lamps. In the embodiment of FIGS. 1 and 2, the lamp 20 is intended to advantageously replace a preheat T5 fluorescent lamp in a light fixture having lamp holders for receiving T5 fluorescent lamps.

Also shown in FIG. 2 is a first resistor 40, a bridge rectifier integrated circuit (IC) 42, and a second resistor 44 of an electric circuit for providing proper electrical voltage and current to the array of LEDs on the opposite side of the PCB 24.

Figure 3:
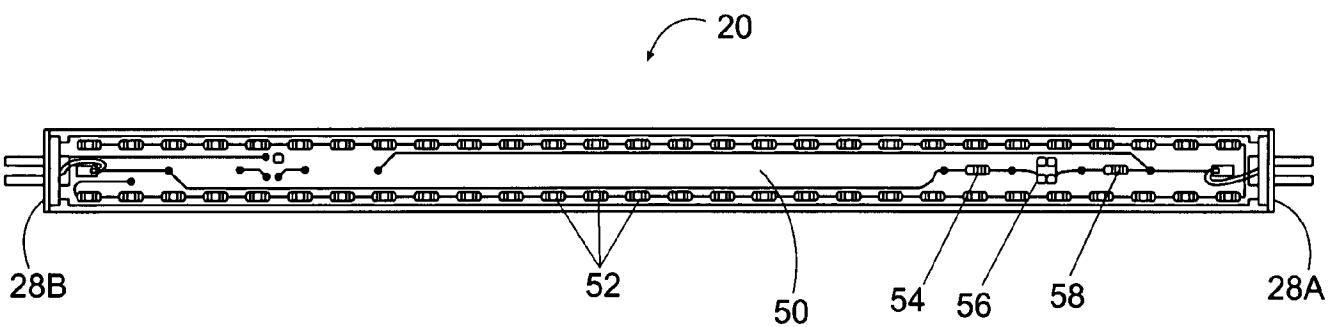
FIG. 3 is a side elevation view of the lamp of FIG. 1 wherein the other side of the PCB visible through the sheath.

FIG. 3 is a side elevation view of the lamp 20 of FIG. 1 wherein a side 50 of the PCB 24 opposite the side 28 is visible through the sheath 26. Similar to the LEDs 22 of FIG. 2, LEDs 52 of the other LED array are mounted along opposite edges of the side 50 of the PCB 24. In the embodiment of FIG. 3, the LEDs 52 number 56; 28 of the LEDs 52 are mounted along one edge of the side 50, and the remaining 28 LEDs 52 are mounted along the opposite edge of the side 50. Conductive traces of the PCB 24 connect all 56 of the LEDs 52 in series.

Also shown in FIG. 3 is a first resistor 54, a bridge rectifier IC 56, and a second resistor 58 of an electric circuit for providing proper electrical voltage and current to the array of LEDs 52 on the side 50 of the PCB 24.

Figure 4:
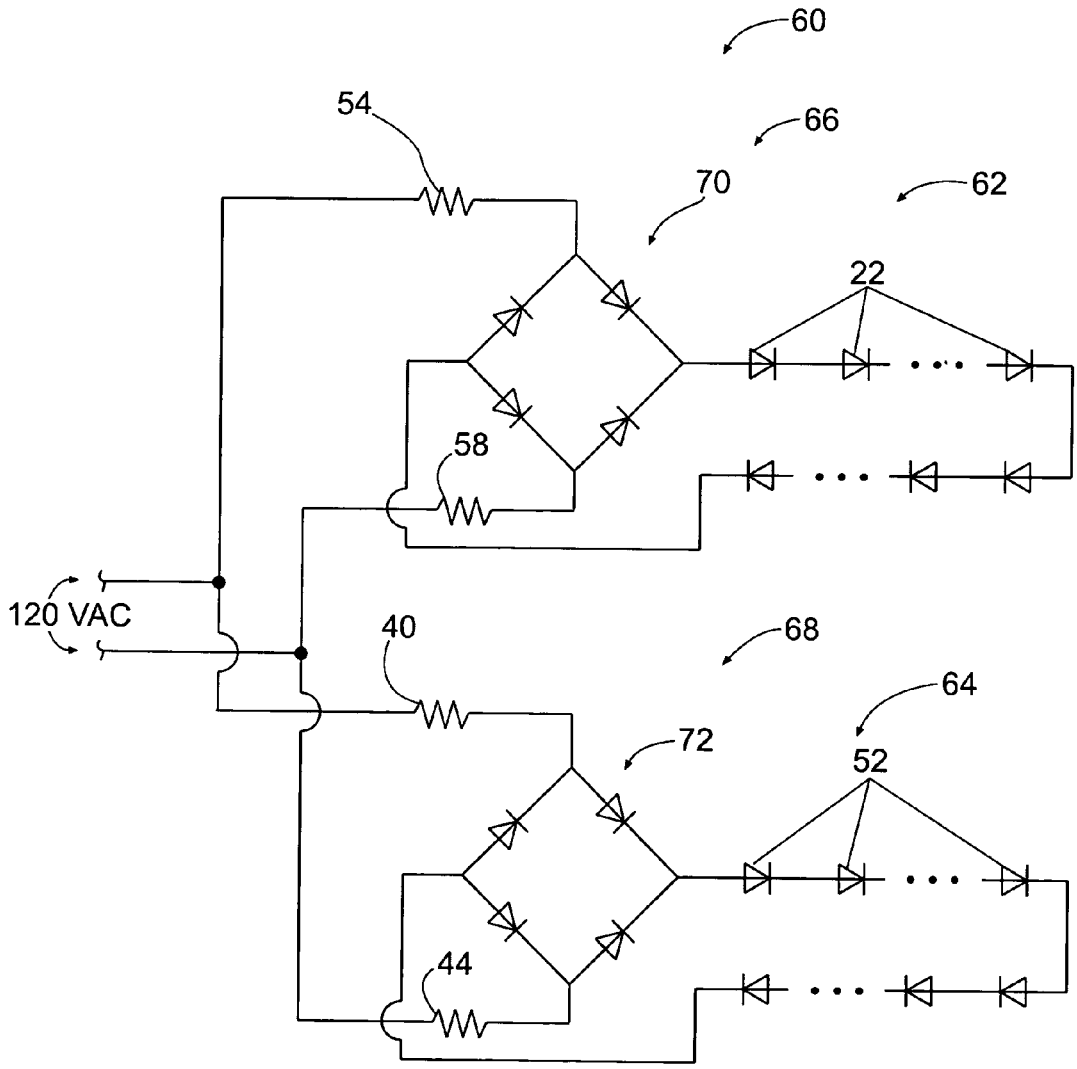
FIG. 4 is a diagram of one embodiment of an electrical circuit for properly illuminating the LEDs of the lamp of FIGS. 1–3.

FIG. 4 is a diagram of one embodiment of an electrical circuit 60 for properly illuminating the LEDs 22 and 52 forming respective LED arrays 62 and 64 of the lamp 20 of FIGS. 1–3. In the embodiment of FIG. 4, the electrical circuit 60 includes two substantially similar sections 66 and 68. The section 66 provides proper electrical voltage and current to the LEDs 22 of the LED array 62, and the section 68 provides proper electrical voltage and current to the LEDs 52 of the LED array 64.

In the embodiment of FIG. 4, the section 66 includes the resistor 54 of FIG. 3, a bridge rectifier circuit 70 within the bridge rectifier IC 56 of FIG. 3, and the resistor 58 of FIG. 3. As described above, the pins 34 at one end of the lamp 20 are connected together, the pins 36 at the other end of the lamp 20 are connected together, and two wires having an alternating current voltage between them are connected to the pins 34 and 36 to provide electrical power to the lamp 20. In the embodiment of FIG. 4, the bridge rectifier circuit 70 receives 120 volts alternating current "VAC" provided to the pins 34 and 36 and rectifies the alternating current (ac) voltage. The resistors 54 and 58 are valued to achieve an electrical current through the LEDs 22 to properly illuminate the LEDs 22.

The section 68 includes the resistor 40 of FIG. 2, a bridge rectifier circuit 72 within the bridge rectifier IC 42 of FIG. 2, and the resistor 44 of FIG. 2. Like the diode array 70, the bridge rectifier circuit 72 receives the 120 VAC and rectifies the ac voltage. The resistors 40 and 44 are valued to achieve an electrical current through the LEDs 52 to properly illuminate the LEDs 52.

Figure 5:
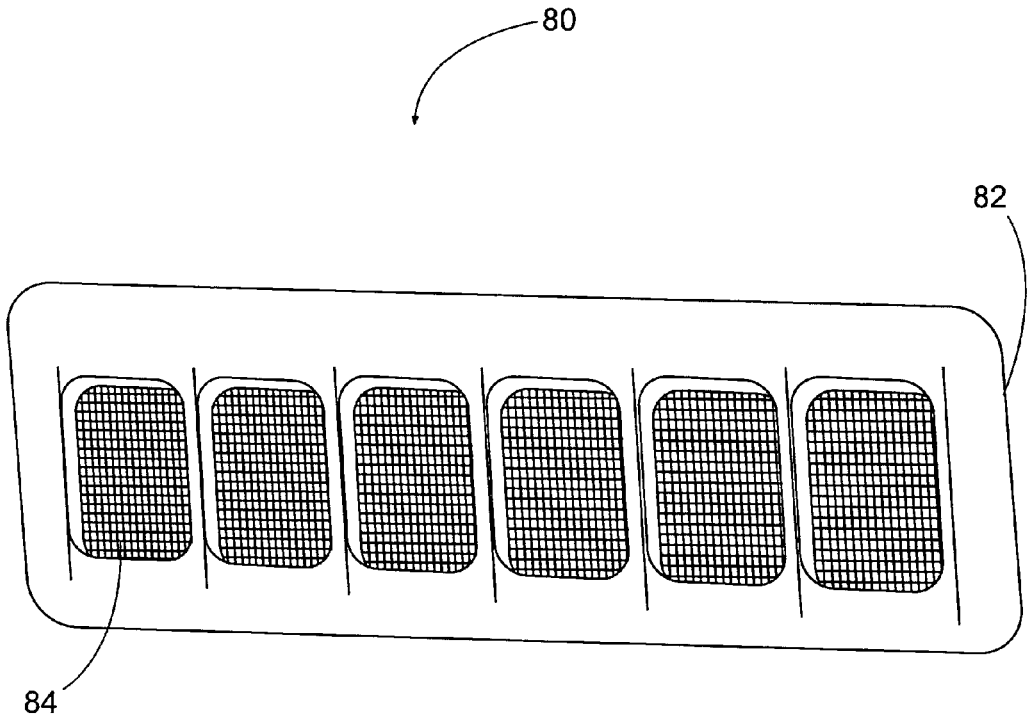
FIG. 5 is a perspective view of one embodiment of a light fixture including the lamp of FIGS. 1–3.

FIG. 5 is a perspective view of one embodiment of a light fixture 80 including the lamp 20 of FIGS. 1–3. In the embodiment of FIG. 5, the light fixture 80 includes a guard 82 positioned over a prismatic lens 84. More specifically, an enclosure housing the lamp 20 has an opening for light produced by the lamp 20 to escape the enclosure. The prismatic lens 84 is positioned over the opening between the guard 82 and the enclosure housing the lamp 20. Visible light produced by the lamp 20 exits the light fixture 80 via the opening in the enclosure and the prismatic lens 84. In general, the prismatic lens 84 is a sheet of a material with pyramid-shaped refracting prisms on one side. The refracting prisms distribute the light emitted by the lamp 20.

The material used to form the prismatic lens 84 is, in general, substantially transparent to the wavelengths of visible light emitted by the LEDs of the lamp 20. The prismatic lens 84 may be, for example, formed from a plastic material or a rugged type of glass. Suitable plastic materials include acrylic plastic resins such as Plexiglas® (Atofina Chemicals, Inc., Philadelphia, Pa.) and polycarbonate resins such as Lexan® (General Electric Company, Schenectady, N.Y.). Suitable rugged types of glass includes borosilicate glass such as Pyrex® (Corning Inc., Corning, N.Y.).

In one embodiment, the light fixture 80 meets the requirements of the generally available U.S. military specification MIL-F-16377/59A(SH) entitled "FIXTURES, LIGHTING; FLUORESCENT, DETAIL LIGHTING FOR STEP ILLUMINATION" dated 9 May 1983, incorporated herein by reference in its entirety.

Figure 6:
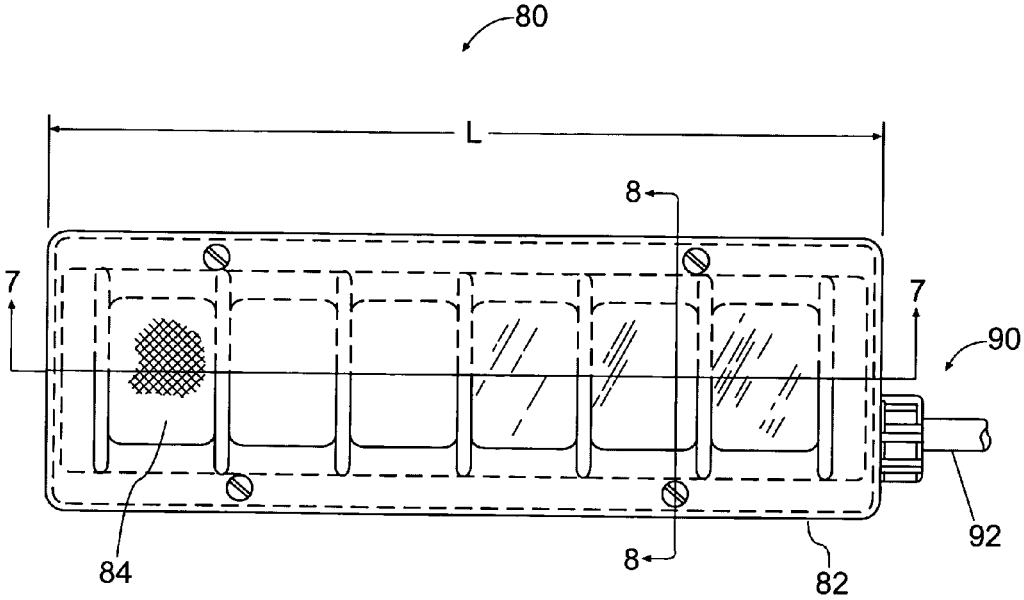
FIG. 6 is a front elevation view of the light fixture of FIG. 5.

FIG. 6 is a front elevation view of the light fixture 80 of FIG. 5. As shown in FIG. 6, the light fixture 80 has a cable entrance assembly 90 for receiving an electrical cable 92. As described in more detail below, the electrical cable 92 has two wires for providing 120 VAC to the lamp 20. In the embodiment of FIG. 6, the light fixture 80 has a length dimension "L" of about 13.84 inches.

Figure 7:
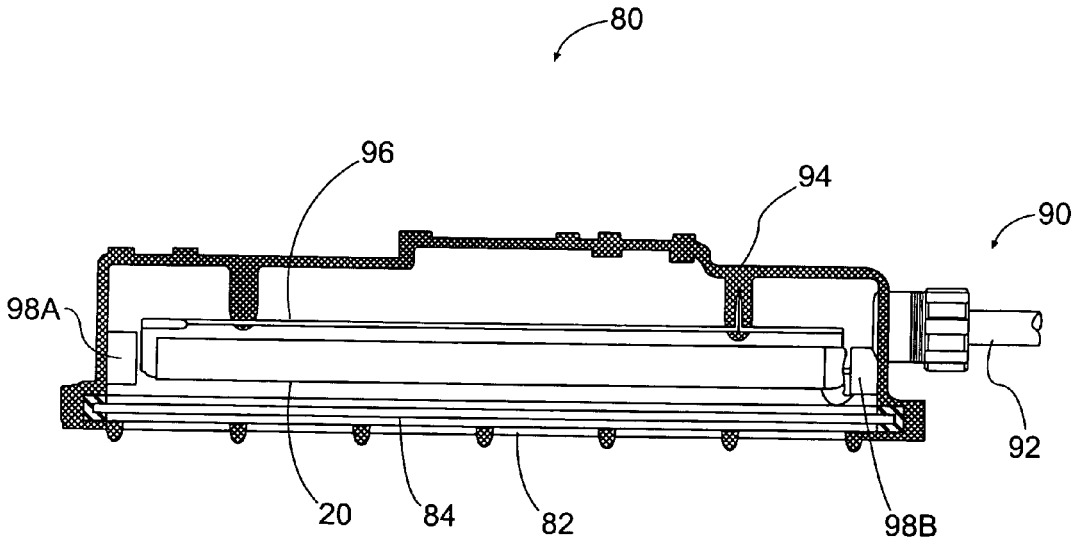
FIG. 7 is a cross-section view of the light fixture of FIG. 6.

FIG. 7 is a cross-section view of the light fixture 80 of FIG. 6 as indicated in FIG. 6. As described above, the prismatic lens 84 is positioned between the guard 82 and an enclosure 94 housing the lamp 20. Two bi-pin lamp holders 98A and 98B positioned in the enclosure 94 receive the pins 34 and 36 of the lamp 20. (See FIG. 1.) A reflector 96 positioned within the enclosure 94 reflects light emitted by the lamp 20 toward the prismatic lens 84.

Figure 8:
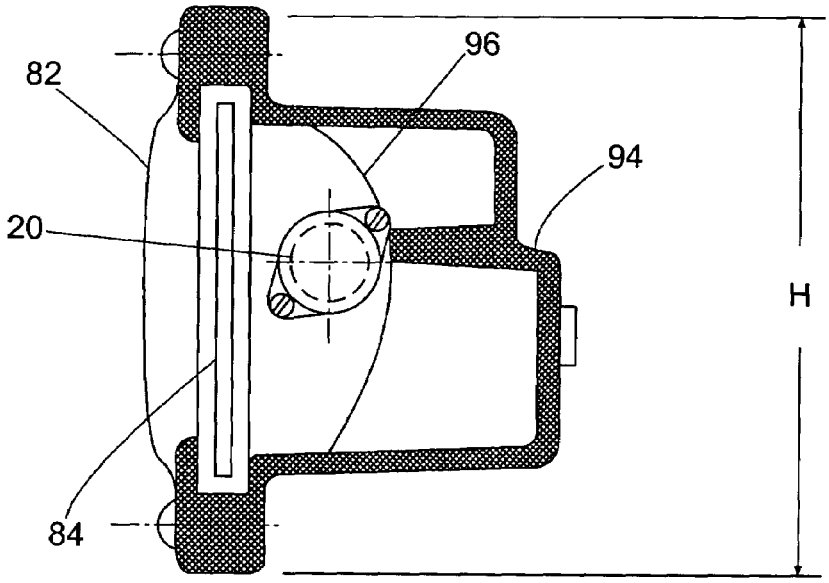
FIG. 8 is another cross-section view of the light fixture of FIG. 6.

FIG. 8 is another cross-section view of the light fixture 80 of FIG. 6 as indicated in FIG. 6. In the embodiment of FIG. 8, the light fixture 80 has a height dimension "H" of about 4.41 inches.

Figure 9:
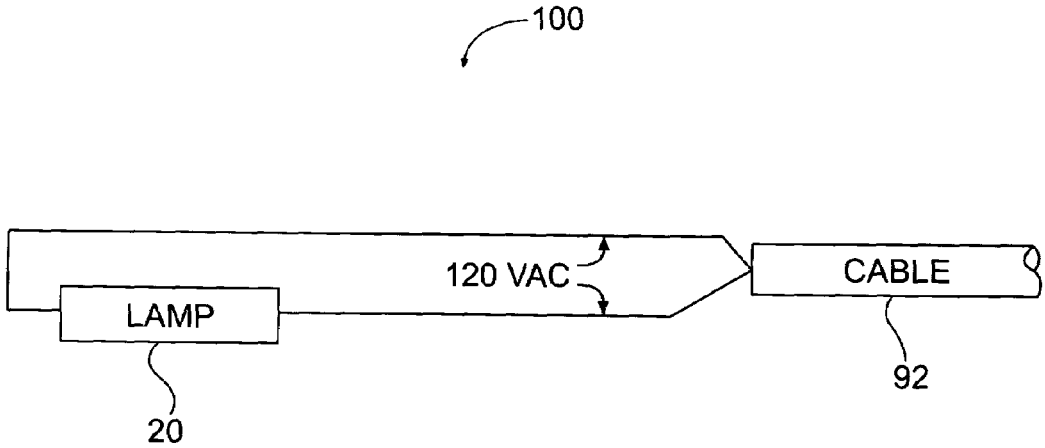
FIG. 9 is a diagram of one embodiment of a circuit for applying electrical power to the lamp of the light fixture of FIGS. 6–8.

FIG. 9 is a diagram of one embodiment of a circuit 100 for applying electrical power to the lamp 20 of the light fixture 80 of FIGS. 6–8. In the embodiment of FIG. 9, the electrical cable 92 has two wires carrying 120 VAC. One of the wires is connected to one end of the lamp 20, and the other wire is connected to the other end of the lamp 20. More specifically, one of the wires is connected to pins 34 of FIG. 1 at end of the lamp 20 via one of the lamp holders 98A and 98B of FIG. 7, and the other wire is connected to the pins 36 of FIG. 1 at the other end of the lamp 20 via the other lamp holder 98A or 98B.

It is noted that fluorescent light fixtures similar to the light fixture 80 of FIGS. 6–9 include preheat fluorescent lamps and associated electrical ballasts and starters. As described above, the LED lamp 20 of the light fixture 80 expectedly dissipates less electrical energy during operation and lasts substantially longer than the preheat fluorescent lamps. In addition, the ballasts of the fluorescent light fixtures dissipate a significant amount of the electrical power provided to the fluorescent light fixtures as heat. Such heat tends to shorten the useful life of light fixtures. Further, the starters of the fluorescent light fixtures are typically short-lived electromechanical devices that must be replaced often. For the above reasons, the light fixture 80 of FIGS. 6–9 including the LED lamp 20 of FIG. 1 is superior to similar fluorescent light fixtures.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A lamp, comprising:

a circuit board having two opposed ends;

a plurality of light-emitting diodes (LEDs) disposed upon the circuit board; and a pair of projections extending outwardly from each of said opposed ends, the pair of projections being electronically connected to the LEDs;

a tubular sheath housing said circuit board, said sheath being substantially translucent to light emitted by the LEDs; and a pair of end caps installed in opposite ends of said sheath, said end caps being adapted to properly position and hold the circuit board in the sheath; each of said end caps having holes adapted to receive a corresponding projection from said circuit board, said end caps being inserted into the opposite ends of the sheath such that said circuit board projections extend into said corresponding holes in said end caps, said circuit board thus being properly positioned and held in said sheath, each of said end caps having at least one terminal for connecting to an electrical power source.

2. The lamp of claim 1 wherein said LEDs are grouped to form two LED arrays, the LEDs comprising one of the two LED array being mounted along opposite edges of one of the sides of said circuit board and wherein the LEDs comprising the other LED array and mounted along opposite edges of the other side of said circuit board.

3. The lamp of claim 1 wherein the LEDs are formed into first and second arrays, said first array being electrically coupled to said second array but physically separated therefrom.

* * * * *